US007931456B2

(12) United States Patent
Bryner et al.

(10) Patent No.: US 7,931,456 B2
(45) Date of Patent: Apr. 26, 2011

(54) ELECTROBLOWING WEB FORMATION

(75) Inventors: Michael Allen Bryner, Midlothian, VA (US); Jack Eugene Armantrout, Richmond, VA (US); Benjamin Scott Johnson, Rocky Mount, NC (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 88 days.

(21) Appl. No.: 12/148,401

(22) Filed: Apr. 18, 2008

(65) Prior Publication Data

US 2008/0213417 A1 Sep. 4, 2008

Related U.S. Application Data

(62) Division of application No. 11/023,067, filed on Dec. 27, 2004.

(51) Int. Cl.
*B29C 47/08* (2006.01)
*D01D 5/14* (2006.01)

(52) U.S. Cl. ..... 425/7; 425/72.2; 425/83.1; 425/174.8 E

(58) Field of Classification Search ..... 425/7, 72.2, 425/174.8 E, 83.1
See application file for complete search history.

(56) References Cited

U.S. PATENT DOCUMENTS

| | | | | |
|---|---|---|---|---|
| 2,160,962 | A * | 6/1939 | Formhals | 264/10 |
| 4,215,682 | A * | 8/1980 | Kubik et al. | 128/205.29 |
| 4,904,174 | A * | 2/1990 | Moosmayer et al. | 425/174.8 E |
| 5,051,159 | A * | 9/1991 | Togashi et al. | 204/165 |
| 7,465,159 | B2 * | 12/2008 | Armantrout et al. | 425/7 |
| 7,582,247 | B2 * | 9/2009 | Armantrout et al. | 264/465 |
| 7,585,451 | B2 * | 9/2009 | Bryner et al. | 264/465 |
| 2002/0089094 | A1 * | 7/2002 | Kleinmeyer et al. | 264/465 |
| 2005/0067732 | A1 | 3/2005 | Kim et al. | |

FOREIGN PATENT DOCUMENTS

WO WO 03/080905 A1 10/2003

* cited by examiner

*Primary Examiner* — Yogendra N Gupta
*Assistant Examiner* — Joseph Leyson

(57) ABSTRACT

An improved electroblowing process is provided for forming a fibrous web of nanofibers wherein polymer stream is issued from a spinning nozzle in a spinneret with the aid of a forwarding gas stream, passes an electrode and a resulting nanofiber web is collected on a collector. The process includes applying a high voltage to the electrode and grounding the spinneret such that an electric field is generated between the spinneret and the electrode of sufficient strength to impart an electrical charge on the polymer as it issues from the spinning nozzle.

5 Claims, 2 Drawing Sheets

ELECTROBLOWING WEB FORMATION

This application is a divisional of U.S. patent application Ser. No. 11/023,067, filed on Dec. 27, 2004.

FIELD OF THE INVENTION

The present invention relates to a process for forming a fibrous web wherein a polymer stream is spun through a spinning nozzle into an electric field of sufficient strength to impart electrical charge on the polymer and wherein a forwarding gas stream aids in transporting the polymer away from the spinning nozzle.

BACKGROUND OF THE INVENTION

PCT publication no. WO 03/080905A discloses an apparatus and method for producing a nanofiber web. The method comprises feeding a polymer solution to a spinning nozzle to which a high voltage is applied while compressed gas is used to envelop the polymer solution in a forwarding gas stream as it exits the spinning nozzle, and collecting the resulting nanofiber web on a grounded suction collector.

There are several disadvantages to the process disclosed in PCT publication no. WO 03/080905A, particularly if the process is carried out on a commercial scale. For one, the spinning nozzle, and the spinneret and spin pack of which the nozzle is a component and all of the associated upstream solution equipment must be maintained at high voltage during the spinning process. Because the polymer solution is conductive, all of the equipment in contact with the polymer solution is brought to high voltage, and if the motor and gear box driving the polymer solution pump are not electrically isolated from the pump, a short circuit will be created which will reduce the voltage potential of the pack to a level insufficient to create the electric fields required to impart charge on the polymer solution.

Another disadvantage of the prior art process is that the process solution and/or solvent supply must be physically interrupted in order to isolate it from the high voltage of the process. Otherwise, the solution and/or solvent supply systems would ground out the pack and eliminate the high electric fields required for imparting charge on the polymer solution.

Additionally, all of the equipment in contact with the electrified polymer solution must be electrically insulated for proper and safe operation. This insulation requirement is extremely difficult to fulfill as this includes large equipment such as spin packs, transfer lines, metering pumps, solution storage tanks, pumps, as well as control equipment and instrumentation such as pressure and temperature gauges. A further complication is that it is cumbersome to design instrumentation and process variable communication systems which can operate at high voltages relative to ground. Furthermore, all exposed sharp angles or corners that are held at high voltage must be rounded, otherwise they will create intense electric fields at those points which may discharge. Potential sources of sharp angles/corners include bolts, angle irons, etc. Moreover, the high voltage introduces a hazard to those persons providing routine maintenance to electrified equipment in support of an on-going manufacturing process. The polymer solutions and solvents being processed are often flammable, creating a further potential danger exacerbated by the presence of the high voltage.

Another disadvantage of the prior art is the necessity of using a quite high voltage. In order to impart electrical charge on the polymer, an electrical field of sufficient strength is needed. Due to the distances involved between the spinning nozzle and the collector, high voltage is used to maintain the electric field. An object of this invention is to lower the voltage used.

Still another disadvantage of the prior art is the coupling of the spinning nozzle to collector distance to the voltage used. During operation of the prior art process, it may be desirable to change the distance of the spinning nozzle to the collector (or the die to collector distance; the "DCD"). However, by changing that distance the electric field generated between the spinning nozzle and the collector changes. This requires changing the voltage in order to maintain the same electric field. Thus, another object of this invention is to decouple the spinning nozzle to collector distance from the electric field.

SUMMARY OF THE INVENTION

In a first embodiment, the present invention is directed to an electroblowing process for forming a fibrous web comprising issuing an electrically charged polymer stream from a spinning nozzle in a spinneret, passing the polymer stream by an electrode to which a voltage is applied and wherein the spinneret is substantially grounded, such that an electric field is generated between the spinneret and the electrode of sufficient strength to impart said electrical charge to the polymer stream as it issues from the spinning nozzle, and collecting nanofibers formed from the charged polymer stream on a collector as a fibrous web.

A second embodiment of the present invention is a fiber spinning apparatus, comprising a polymer supply vessel connected to an inlet side of a spinneret having a polymer flow passage disposed therein, said polymer flow passage exiting said spinneret through at least one spinning nozzle, forwarding gas nozzles having exits disposed adjacent to and directed toward said spinning nozzle, said spinning nozzle extending beyond the exits of said gas nozzles, at least one electrode disposed downstream of said gas nozzles, but outside of a gas flow path established by the direction of the gas flow nozzles, and a fiber collector disposed downstream of said spinning nozzle, wherein each of said spinneret, said electrode and said fiber collector are electrically connected to a circuit containing a high voltage supply, such that each can be individually charged to a potential.

Definitions

The terms "electroblowing" and "electro-blown spinning" herein refer interchangeably to a process for forming a fibrous web by which a forwarding gas stream is directed generally towards a collector, into which gas stream a polymer stream is injected from a spinning nozzle, thereby forming a fibrous web which is collected on the collector, wherein a voltage differential is maintained between the spinning nozzle and an electrode and the voltage differential is of sufficient strength to impart charge on the polymer as it issues from the spinning nozzle.

The term "nanofibers" refers to fibers having diameters of less than 1,000 nanometers.

DETAILED DESCRIPTION OF THE INVENTION

Figure 1:
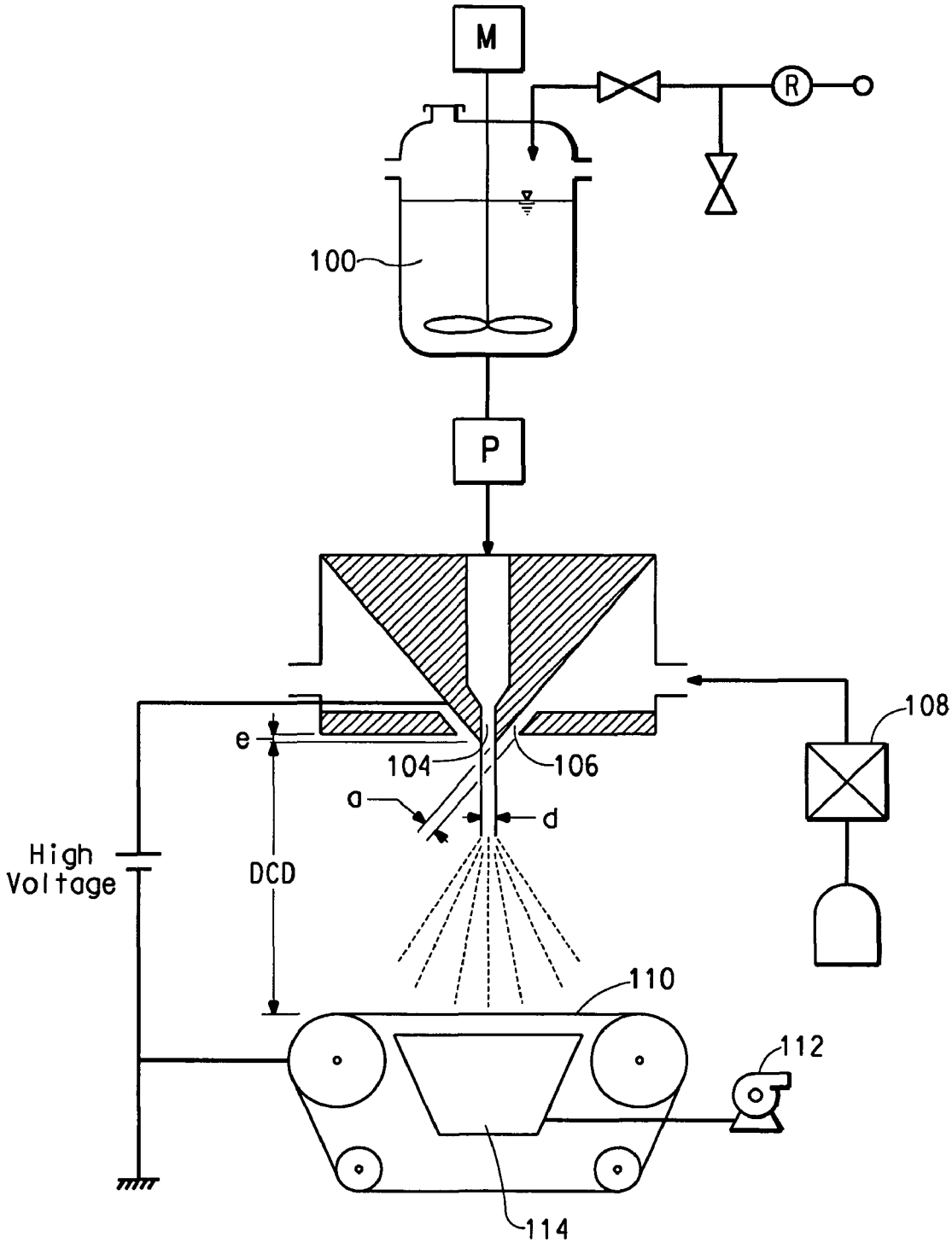
FIG. 1 (Prior Art)
FIG. 1 is an illustration of the prior art electroblowing apparatus.

Reference will now be made in detail to the presently preferred embodiments of the invention, examples of which are illustrated in the accompanying drawings. Throughout the drawings, like reference characters are used to designate like elements.

An electroblowing process and apparatus for forming a fibrous web is disclosed in PCT publication number WO 03/080905A (FIG. 1), corresponding to U.S. Ser. No. 10/477,882, filed Nov. 19, 2003, the contents of which are hereby incorporated by reference. There are several disadvantages to this process, as already described above.

Figure 2:
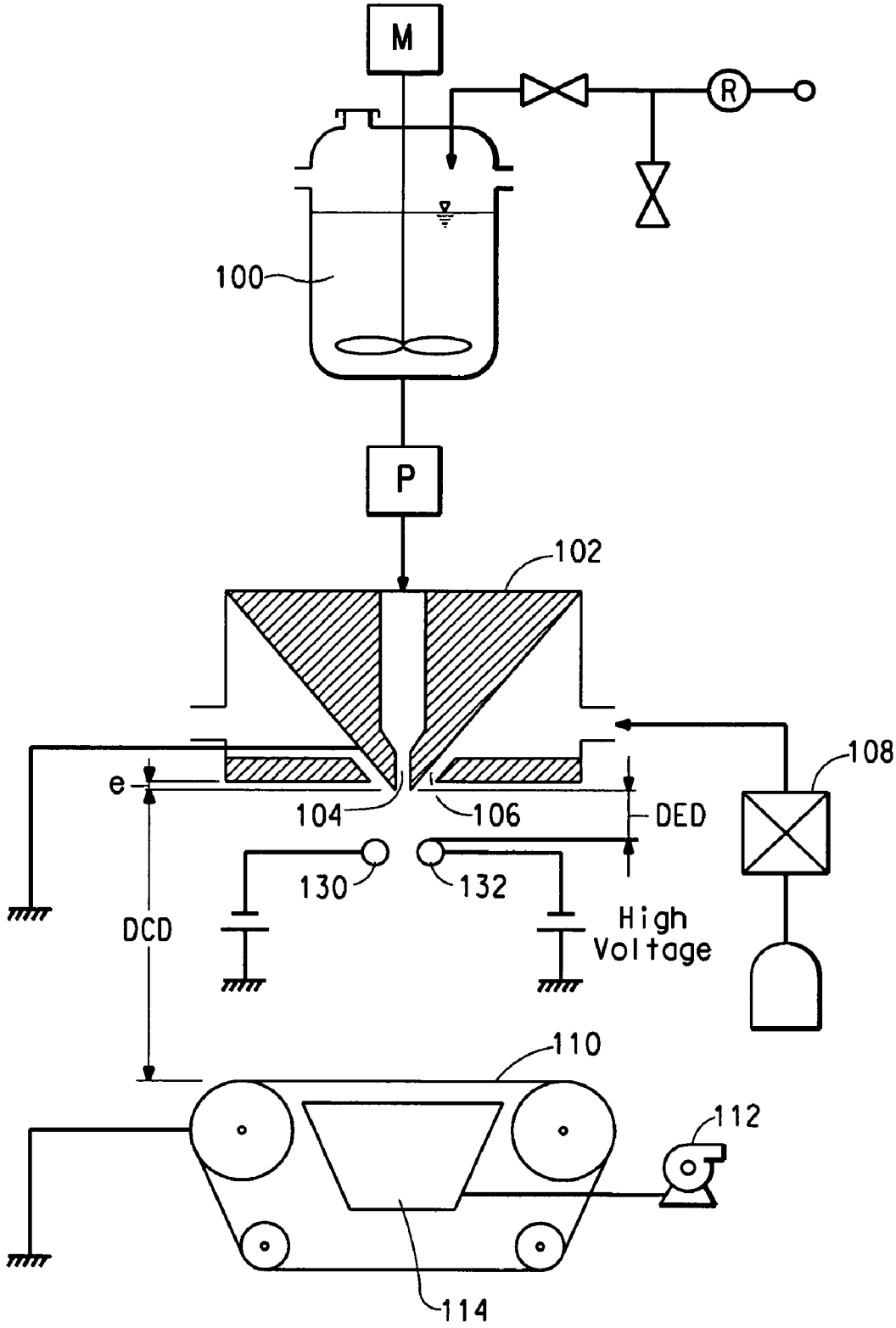
FIG. 2 is a schematic of a process and apparatus according to the present invention.

In the process of the present invention, referring to FIG. 2, according to one embodiment of the invention, a polymer stream comprising a polymer and a solvent, or a polymer melt, is fed from a storage tank, or in the case of a polymer melt from an extruder 100 to a spinning nozzle 104 (also referred to as a "die") located in a spinneret 102 through which the polymer stream is discharged. The polymer stream passes through an electric field generated between spinneret 102 and electrodes 130 and 132 as it is discharged from the spinneret 102. Compressed gas, which may optionally be heated or cooled in a gas temperature controller 108, is issued from gas nozzles 106 disposed adjacent to or peripherally to the spinning nozzle 104. The gas is directed generally in the direction of the polymer stream flow, in a forwarding gas stream which forwards the newly issued polymer stream and aids in the formation of the fibrous web.

While not wishing to be bound by theory, it is believed that the forwarding gas stream provides the majority of the forwarding forces in the initial stages of drawing of the fibers from the issued polymer stream and in the case of polymer solution, simultaneously strips away the mass boundary layer along the individual fiber surface thereby greatly increasing the diffusion rate of solvent from the polymer solution in the form of gas during the formation of the fibrous web.

At some point, the local electric field around the polymer stream is of sufficient strength that the electrical force becomes the dominant drawing force which ultimately draws individual fibers from the polymer stream to diameters measured in the hundreds of nanometers or less.

It is believed that the angular geometry of the tip of the spinning nozzle 104, also referred to as the "die tip," creates an intense electric field in the three-dimensional space surrounding the tip which causes charge to be imparted to the polymer stream. The spinning nozzle may be in the form of a capillary of any desired cross-sectional shape, or in the form of a linear array of such capillaries. In the embodiment in which the die tip is an angular beam containing a linear capillary array of spinning nozzles, the forwarding gas stream is issued from gas nozzles 106 on each side of the spinneret 102. The gas nozzles 106 are in the form of slots formed between elongated knife edges, one on each side of the spinneret 102, along the length of the linear capillary array, and the spinneret 102. Alternately, in the embodiment in which the die tip is in the form of a single capillary, the gas nozzle 106 may be in the form of a circumferential slot surrounding the spinneret 102. The gas nozzles 106 are directed toward the spinning nozzle, generally in the direction of the polymer stream flow. The angular die tip, and therefore the spinning nozzle(s), is positioned such that it extends beyond the end of the spinneret and gas nozzles a distance "e" (FIG. 2). It is believed that the electric field combined with the charge on the polymer stream provides spreading forces which act on the fibers and fibrils formed therein, causing the web to be better dispersed and providing for very uniform web laydown on the collection surface of the collector.

Advantageously, the polymer solution is electrically conductive. Examples of polymers for use in the invention may include polyimide, nylon, polyaramide, polybenzimidazole, polyetherimide, polyacrylonitrile, PET (polyethylene terephthalate), polypropylene, polyaniline, polyethylene oxide, PEN (polyethylene naphthalate), PBT (polybutylene terephthalate), SBR (styrene butadiene rubber), polystyrene, PVC (polyvinyl chloride), polyvinyl alcohol, PVDF (polyvinylidene fluoride), polyvinyl butylene and copolymer or derivative compounds thereof. The polymer solution is prepared by selecting a solvent suitable to dissolve the polymer. The polymer solution can be mixed with additives including any resin compatible with an associated polymer, plasticizer, ultraviolet ray stabilizer, crosslink agent, curing agent, reaction initiator, electrical dopant, etc. Any polymer solution known to be suitable for use in a conventional electrospinning process may be used in the process of the invention.

In another embodiment of the invention, the polymer stream fed to the spin pack and discharged through the nozzle in the spinneret is a polymer melt. Any polymer known to be suitable for use in a melt electrospinning process may be used in the process in the form of a polymer melt.

Polymer melts and polymer-solvent combinations suitable for use in the process are disclosed in Z. M. Huang et al., Composites Science and Technology, volume 63 (2003), pages 2226-2230, which is herein incorporated by reference.

Advantageously, the polymer discharge pressure is in the range of about 0.01 kg/cm$^2$ to about 200 kg/cm$^2$, more advantageously in the range of about 0.1 kg/cm$^2$ to about 20 kg/cm$^2$, and the polymer stream throughput per hole is in the range of about 0.1 cc/min to about 15 cc/min.

The velocity of the compressed gas issued from gas nozzles 106 is advantageously between about 10 and about 20,000 m/min, and more advantageously between about 100 and about 3,000 m/min.

After the polymer stream exits the spinning nozzle 104 it passes by electrodes 130 and 132, as shown in FIG. 2. These electrodes can be combined into one unit as a ring-shaped electrode, or kept separate as bars. Whereas a ring-shaped electrode can be used for one or more spinning nozzles, bar electrodes extending substantially the entire length of the spinning beam and/or the capillary array, can be used for a beam containing a linear array of spinning nozzles. The electrode(s) is positioned outside the gas flow path established by the gas nozzles, so as to not interfere with the flow of the forwarding gas or the polymer stream. The distance between the spinning nozzle and the electrode (also referred to as the "die to electrode distance" or "DED") is in the range of about 0.01 to about 100 cm, and more advantageously in the range of about 0.1 to about 25 cm. The electrode can also be placed between the spinning nozzle and the spinneret, within distance "e" (FIG. 2), wherein the distance from the spinning nozzle to the collector is less than the distance from the electrode to the collector. However, this embodiment provides a less effective electric field than the embodiment of having the electrode located downstream of the spinning nozzle.

The process of the invention avoids the necessity of maintaining the spin pack including the spinneret, as well as all other upstream equipment, at high voltage, as described above. By applying the voltage to the electrode, the pack and the spinneret may be grounded or substantially grounded. By "substantially grounded" is meant that the spinneret preferentially may be held at a low voltage level, i.e., between about −100 V and about +100 V. However, it is also understood that the spinneret can have a significant voltage provided the electrode has a voltage that maintains a desired voltage differential between the spinneret and the electrode. This voltage differential can have a positive or negative polarity with respect to the ground potential. In one embodiment, the spinneret and the electrode can have the same voltage but with different polarities. The voltage differential between the spinneret and the electrode is in the range of about 1 to about 100 kV, and even in the range of about 2 to about 50 kV, and even as low as about 2 to about 30 kV.

Located a distance below the spinneret 102 is a collector for collecting the fibrous web produced. In FIG. 2, the collector comprises a moving belt 110 onto which the fibrous web is collected, and can include a porous fibrous scrim which is moving on said moving belt, onto which the fibrous web formed by the present process is deposited. The belt 110 is advantageously made from a porous material such as a metal screen so that a vacuum can be drawn from beneath the belt through vacuum chamber 114 from the inlet of blower 112. In this embodiment of the invention, the collection belt is substantially grounded. In the embodiment where the collection belt is substantially grounded, a second electric field is generated between the collector and the electrode, such that the potential difference between the electrode and the collector is less than the potential difference between the spinneret and the electrode. The collected fibrous web of nanofibers is sent to a wind-up roll, not shown.

It has been found that the distance between the spinneret and the collection surface (also referred to as the "die to collector distance" or "DCD"; illustrated in FIG. 2) is in the range of about 1 to about 200 cm, and more advantageously in the range of about 10 to about 50 cm.

It has further been found that when the tip of the spinning nozzle or die tip protrudes from the spinneret by a distance e (FIG. 2), such that the distance between the spinning nozzle and the collection surface is less than the distance between the spinneret and the collection surface, a more uniform electric field results. Not wishing to be bound by theory, it is believed that this is because the protruding spinning nozzle establishes a sharp edge or point in space which concentrates the electric field.

EXAMPLES

Example 1

Poly(ethylene oxide) (PEO), viscosity average molecular weight (Mv) ~300,000, available from Sigma-Aldrich, St Louis, Mo. was dissolved in deionized water to make a 10% by weight PEO solution. The solution electrical conductivity was measured to be 47 Micro-Siemens/cm using a VWR digital conductivity meter available from VWR Scientific Products (VWR International, Inc., West Chester, Pa.). The solution was spun in a single orifice electroblowing apparatus comprising a 26 gauge blunt syringe needle, in a concentric forwarding air jet. The needle tip protruded 2.5 mm below the conductive face of the spin pack body. The spin pack body and the spin orifice were electrically grounded through an ammeter, and the PEO solution was directed through a ring-shaped electrode, which was charged to a high voltage. Process conditions are set forth in the Table, below.

PEO fibers formed via this process were collected on a grounded conductive surface and examined under a scanning electron microscope. Fiber diameters ranged from about 91 to about 730 nanometers. The mean fiber diameter was visually estimated to be about 300 nanometers.

Example 2

The procedure of Example 1 was followed except with a smaller inside diameter electrode, with the electrode located closer to the die tip and with a lower voltage applied to the electrode. Process conditions are set forth in the Table, below. Fibers diameters were determined to be in the range of about 230 to about 880 nanometers with the mean fiber diameter estimated to be about 400 nanometers.

The fibers produced from Example 2 were similar in size to those fibers produced from Example 1. The procedure of Example 2 shows that by decreasing the electrode inside diameter and decreasing the DED, the applied voltage to the electrode can be reduced and still generate similar sized fibers as Example 1.

Example 3

The procedure of Example 2 was repeated except with a slightly higher voltage on the electrode. Process conditions are set forth in the Table, below. Fiber diameters were determined to be in the range of about 180 to about 350 nanometers with the mean estimated to be about 290 nanometers.

The fibers produced from Example 3 were similar in size to those fibers produced from Examples 1 and 2.

TABLE

| Spinning Conditions | Ex. 1 | Ex. 2 | Ex. 3 |
|---|---|---|---|
| Throughput (mL/min) | 0.5 | 0.5 | 0.5 |
| Volumetric Airflow (L/min) | 24.5 | 24.5 | 24.5 |
| Air Flow Velocity (m/s) | 12 | 12 | 12 |
| Electrode Inside Diameter (mm) | 28.2 | 22.9 | 22.9 |
| Die to Electrode Distance (mm) | 25.4 | 12.7 | 12.7 |
| Polarity | negative | negative | negative |
| Voltage (kV) | 30 | 14 | 16 |
| Die to Collector Distance (cm) | 30 | 30 | 30 |

Comparative Example

A procedure was followed in accordance with PCT publication number WO 03/080905A. The procedure included a 0.1 meter spin pack with no electrode present. A high voltage of −60 kV was applied to the spinneret and the collector was grounded.

A 22% by weight solution of nylon 6 (type BS400N obtained from BASF Corporation, Mount Olive, N.J.) in formic acid (obtained from Kemira Industrial Chemicals, Helsinki, Finland) was electroblown through a spinneret of 100 mm wide, having 11 spinning nozzles at a throughput rate of 1.5 cc/hole. A forwarding air stream was introduced through air nozzles at a flow rate of 4 scfm (2 liters per second). The air was heated to about 70° C. The distance from the spinneret to the upper surface of the collector was approximately 300 mm. The process ran for about 1 minute.

Nineteen fibers from the product collected were measured for fiber diameter. The average fiber size was 390 nm with a standard deviation of 85.

Examples 1-3 demonstrate that the use of an electrode positioned and charged in accordance with the present invention requires less voltage than the method of the prior art to produce nanofibers with similar fiber diameters.

What is claimed is:

1. A fiber spinning apparatus, comprising:

a polymer supply vessel connected to an inlet side of a spinneret having a polymer flow passage disposed therein, said polymer flow passage exiting said spinneret through at least one spinning nozzle; forwarding gas nozzles having exits disposed adjacent to and directed toward said spinning nozzle, said spinning nozzle extending beyond the exits of said gas nozzles; at least one electrode disposed downstream of said gas nozzles, but outside of a gas flow path established by the direction of the gas flow nozzles; and a fiber collector disposed downstream of said spinning nozzle, wherein each of said electrode and said fiber collector are electrically connected to a circuit containing a high voltage supply, such that each can be individually charged to a potential, and the spinneret is grounded, and the spinning nozzle has a tip, said tip having an angular geometry such that an electric field is caused between the tip and the electrode.

2. The fiber spinning apparatus of claim 1, wherein said polymer supply vessel is a storage tank for a polymer solution.

3. The fiber spinning apparatus of claim 1, wherein said polymer supply vessel is a melt extruder for a polymer melt.

4. The fiber spinning apparatus of claim 1, wherein said gas nozzles are circumferential slots surrounding said spinning nozzle.

5. The fiber spinning apparatus of claim 1, wherein said spinneret is a beam having a linear capillary array of spinning nozzles contained therein each having an angular tip and polymer flow passage defined therein, with said polymer flow passage exiting said spinneret at said angular tip of each spinning nozzle, said forwarding gas nozzles are slots running along the length of said linear array, formed between said angular tip and elongated knife edges disposed on either side of said angular tip, and said electrode comprises two bars running the length of said spinneret.

* * * * *